US011824267B2

(12) United States Patent
Jiang et al.

(10) Patent No.: US 11,824,267 B2
(45) Date of Patent: Nov. 21, 2023

(54) COMPACT DUAL-BAND TRIPLE-POLARIZED ANTENNA BASED ON SHIELDED MUSHROOM STRUCTURES

(71) Applicants: SOUTHEAST UNIVERSITY, Nanjing (CN); PURPLE MOUNTAIN LABORATORIES, Nanjing (CN)

(72) Inventors: Zhihao Jiang, Nanjing (CN); Ke Zhang, Nanjing (CN); Wei Hong, Nanjing (CN)

(73) Assignees: SOUTHEAST UNIVERSITY, Nanjing (CN); PURPLE MOUNTAIN LABORATORIES, Nanjing (CN)

( * ) Notice: Subject to any disclaimer, the term of this patent is extended or adjusted under 35 U.S.C. 154(b) by 15 days.

(21) Appl. No.: 17/605,005

(22) PCT Filed: Jan. 12, 2021

(86) PCT No.: PCT/CN2021/071183
§ 371 (c)(1),
(2) Date: Oct. 20, 2021

(87) PCT Pub. No.: WO2022/068121
PCT Pub. Date: Apr. 7, 2022

(65) Prior Publication Data

US 2022/0278466 A1 Sep. 1, 2022

(30) Foreign Application Priority Data

Sep. 30, 2020 (CN) ..... 202011064313.5

(51) Int. Cl.
*H01Q 21/06* (2006.01)
*H01Q 21/24* (2006.01)
(Continued)

(52) U.S. Cl.
CPC ..... *H01Q 21/24* (2013.01); *H01Q 1/36* (2013.01); *H01Q 9/0421* (2013.01);
(Continued)

(58) Field of Classification Search
CPC ..... H01Q 21/24; H01Q 1/36; H01Q 9/0421; H01Q 9/0464; H01Q 19/005; H01Q 21/0037; H01Q 21/065; H01Q 21/30
See application file for complete search history.

(56) References Cited

U.S. PATENT DOCUMENTS

2018/0090852 A1 3/2018 Dufilie et al.
2019/0288382 A1* 9/2019 Kamgaing ..... H01Q 21/22

FOREIGN PATENT DOCUMENTS

CN 102931479 A * 2/2013
CN 110492239 A 11/2019
(Continued)

*Primary Examiner* — Dieu Hien T Duong
(74) *Attorney, Agent, or Firm* — Bayramoglu Law Offices LLC

(57) ABSTRACT

A compact dual-band triple-polarized antenna based on shielded mushroom structures includes a vertically-polarized radiator and a horizontally-polarized radiator. Two parts are fixedly connected in a disc-shaped structure. The vertically-polarized radiator and the horizontally-polarized radiator are both multilayer structures. Each multilayer structure includes a plurality of concentric circles, and the plurality of concentric circles include a plurality of dielectric substrates. The vertically-polarized radiator and horizontally-polarized radiator each include a plurality of shielded mushroom cell structures. Each shielded mushroom cell structure includes at least three metal layers and a metallic shorting pin, and the metallic shorting pin connects at least two of the at least three metal layers. By controlling dispersion properties of the each shielded mushroom cell structure, a multi-frequency pattern diversity device possessing both vertical
(Continued)

polarization and dual horizontal polarization radiation characteristics in two pre-defined frequencies is designed.

9 Claims, 20 Drawing Sheets

(51) Int. Cl.

| | |
|---|---|
| ***H01Q 1/36*** | (2006.01) |
| ***H01Q 9/04*** | (2006.01) |
| ***H01Q 19/00*** | (2006.01) |
| ***H01Q 21/00*** | (2006.01) |
| ***H01Q 21/30*** | (2006.01) |

(52) U.S. Cl.
CPC ..... *H01Q 9/0464* (2013.01); *H01Q 19/005* (2013.01); *H01Q 21/0037* (2013.01); *H01Q 21/065* (2013.01); *H01Q 21/30* (2013.01)

(56) References Cited

FOREIGN PATENT DOCUMENTS

| | | | |
|---|---|---|---|
| CN | 110854529 | A | 2/2020 |
| CN | 112201936 | A | 1/2021 |

* cited by examiner

*xz-plane*

*yz-plane*

*xy-plane*

Measured $E_\varphi$; Measured $E_\theta$; Simulated $E_\varphi$; Simulated $E_\theta$

*xz-plane*

*yz-plane*

*xy-plane*

———: Measured $E_\varphi$ – · – · – : Measured $E_\theta$ ------: Simulated $E_\varphi$ ·····: Simulated $E_\theta$

*xz-plane*

*yz-plane*

*xy-plane*

……: Measured $E_{\varphi}$ – · – · – : Measured $E_{\theta}$ ------: Simulated $E_{\varphi}$ ·····: Simulated $E_{\theta}$ : Measured $E_{\varphi}$ - - - - : Measured $E_{\theta}$ ------: Simulated $E_{\varphi}$ ·····: Simulated $E_{\theta}$

*xz-plane*

*yz-plane*

*xy-plane*

———: Measured $E_\varphi$ - - - - : Measured $E_\theta$ ------: Simulated $E_\varphi$ ·····: Simulated $E_\theta$

COMPACT DUAL-BAND TRIPLE-POLARIZED ANTENNA BASED ON SHIELDED MUSHROOM STRUCTURES

CROSS REFERENCE TO THE RELATED APPLICATIONS

This application is the national stage entry of International Application No. PCT/CN2021/071183, filed on Jan. 12, 2021, which is based upon and claims priority to Chinese Patent Application No. 202011064313.5 filed on Sep. 30, 2020, the entire contents of which are incorporated herein by reference.

TECHNICAL FIELD

The present invention belongs to the field of electronic devices for wireless communication systems, and specifically relates to a compact dual-band triple-polarized antenna based on shielded mushroom structures.

BACKGROUND

With the continuous development of the wireless communication technology and the rapid evolution of highly-integrated electronic devices, the diversity of information acquisition methods and information interaction have been promoted, and devices that operate in wireless local area networks have emerged accordingly.

In modern communication systems, improving the communication capacity of the system has become the key to the development of wireless technology. In order to provide multi-functional services and to work properly in a complex electromagnetic environment, the demand for dual frequency bands in communication systems is growing rapidly, which requires that antennas should work within a plurality of frequency bands to satisfy services in different frequency bands. On the other hand, systems possessing polarization and pattern diversity characteristics can provide different radiation characteristics so as to ensure the reliability of communication. Therefore, antennas possessing multi-band and diversity characteristics can utilize a plurality of channels in frequency and polarization to reduce multipath effects and increase data transmission rates. Moreover, a diversity antenna having a plurality of frequency bands has a more compact structure than a combination of a plurality of antennas having a single frequency band, so the advantage of miniaturization is also more preferable in the system.

For such a type of multiple-input multiple-output antennas, port isolation and pattern orthogonality would be important challenges for the research in this field. Recently, some scholars have proposed that A single-port antenna that provides different and/or the same polarizations and patterns in different bands. Although different polarizations and patterns can be supported in different frequency bands, the pattern diversity cannot be achieved in each of the frequency bands.

A multi-port antenna that each port corresponds to a single band with a distinct pattern and/or polarization in both bands. This type of antenna is more suitable for connecting single-band systems having different modes or polarizations, but cannot fully utilize the diversity in each band.

A multi-port antenna that each port supports a distinct pattern and/or polarization simultaneously in two frequency bands, so that the diversity characteristics of polarization and patterns can be simultaneously realized. However, the existing application of such antennas is limited by deficiencies such as a small number of polarizations, a high profile, a small frequency ratio, and the like.

SUMMARY

Objective of the invention: In order to overcome the shortcomings in the prior art, the present invention provides a compact dual-band triple-polarized antenna based on shielded mushroom structures. By controlling the dispersion properties of the shielded mushroom cell structure, a multi-frequency pattern diversity radiation device having both vertical polarization radiation characteristics and dual horizontal polarization radiation characteristics in two designated frequency bands is designed.

Technical solution: In order to achieve the above objective, the present invention provides a compact dual-band triple-polarized antenna based on shielded mushroom structures, including a vertically-polarized radiator and a horizontally-polarized radiator; the horizontally-polarized radiator is located on one side of the vertically-polarized radiator, and two parts is fixedly connected in a disc-shaped structure; the vertically-polarized radiator and the horizontally-polarized radiator are both multilayer structures; the multilayer structure includes a plurality of concentric circles, and the concentric circles include a plurality of dielectric substrates; the vertically-polarized radiator and the horizontally-polarized radiator include a plurality of shielded mushroom cell structures, respectively; the shielded mushroom cell structure each include at least three metal layers and a metallic shorting pin; and the shorting pin connects at least two of the metal layers.

Preferably, the vertically-polarized radiator includes in sequence from one side to another side: a top patch of the vertically polarized radiator, a parasitic disc patch, an annular patch array, and a metal floor of the lower radiator; and further includes a plurality of shorting pin ring arrays connecting the annular patch array to the metal floor of the lower radiator, where the annular patch array includes 2-5 concentric annular patches; the annular patches include a plurality of patches; the patches are connected to a plurality of shorting pin ring arrays; and the top patch of the vertically-polarized radiator is adhered to the horizontally-polarized radiator.

It can be seen that the shielded mushroom cell structure of the vertically-polarized radiator includes the patches, the shorting pin, and the metal floor of the lower radiator.

Preferably, the horizontally-polarized radiator includes in sequence from one side to another side: a top patch of the horizontally polarized radiator, a patch array, and a metal floor of the upper radiator; and further includes a plurality of shorting pin arrays connecting the patch array to the metal floor of the upper radiator, where the metal floor of the upper radiator is adhered to the vertically-polarized radiator.

It can be seen that the shielded mushroom cell structure of the horizontally-polarized radiator includes the patches, the shorting pin, and the metal floor of the upper radiator.

Preferably, a feeding structure of the vertically-polarized radiator includes a vertical-body coaxial waveguide port connected to the parasitic disc patch and the metal floor of the lower radiator.

Preferably, a feeding structure of the horizontally-polarized radiator includes horizontally-polarized coaxial waveguide ports and microstrips connected and loaded by the horizontally-polarized coaxial waveguide ports;

the microstrips are located between the top patch of the horizontally-polarized radiator and the patch array;

the horizontally-polarized coaxial waveguide ports are connected to the patch array and the metal floor of the upper radiator; and an included angle of 90° is formed between the horizontally-polarized coaxial waveguide ports, and an included angle of 90° is formed between the microstrips.

Preferably, one side of the vertically-polarized radiator includes two non-metallized via holes.

Preferably, the horizontally-polarized radiator is fixed to the vertically-polarized radiator by using a non-metallic fixing device. The fixing device can be made of a nylon material herein, for example but not limited to nylon screws.

Preferably, the patch array is annular or polygonal. The patch array can include a plurality of patches. The patch arrays of the vertically-polarized radiator and the horizontally-polarized radiator can be distinguished by patch arrays of different shapes, for example but not limited to a ring or a polygon. The polygon includes but is not limited to a square, a triangle, and a hexagon.

Preferably, the horizontally-polarized radiator includes a symmetrical rectangular radiator structure, so as to generate dual horizontal polarization.

Preferably, the vertically-polarized coaxial waveguide port loads a shorting pin in a direction with $\varphi=45°$, and the shorting pin connects the top circular patch to the metal floor of the lower radiator. The structure is combined with the feeding structure of the vertically-polarized radiator to adjust reflection coefficient performance of the vertically-polarized radiator.

The beneficial effect is that the present invention provides a compact dual-band triple-polarized antenna based on shielded mushroom structures. By controlling the dispersion properties of the shielded mushroom cell structure, a multi-band diversity device possessing vertical polarization s and dual horizontal polarization radiation characteristics in two predefined frequency bands can be designed. The antenna has a very low profile at the wavelength of 2.4 GHz in free space. The antenna can simultaneously support vertical polarization, y-horizontal-polarization, and x-horizontal-polarization in dual bands, possessing good pattern orthogonality. Isolation between the antenna input ports is higher than 15 dB. The antenna has a radiation efficiency above 94%, an envelope correlation coefficient less than 0.01, and the independent band-tuning capability. Compared with the existing multi-band multi-polarized antennas, the present invention can simultaneously support a plurality of communication modes in dual bands. Compared with similar researches, the present invention has advantages such as smaller size, higher radiation efficiency, higher gains, more polarization numbers, and the like, which has important prospects in the field of multi-input multi-output communication in the future. Details are as follows:

1) The dual-band triple-polarized antenna can simultaneously support a vertical polarization and dual horizontal polarization radiation patterns (three modes in total) in a dual frequency band (2.4 GHz and 5.8 GHz). Compared with the previous dual-band multi-mode antennas, the antenna can support multiple radiation modes in each frequency band, avoiding disadvantages that the diversity cannot be fully utilized caused by one port corresponds to a single band. Moreover, compared with the existing antennas, the proposed antenna further supplements a plurality of polarization numbers, which can effectively improve link stability and data transmission rates in a multipath environment, and broaden the signal coverage.

2) The antenna has a compact structure and a small electrical size. The two radiators of the antenna can be designed to achieve the required working modes by adjusting the dispersion properties of the same shielded mushroom structure.

3) The antenna has radiation efficiency of up to 94% in two operating frequency bands. In addition, the antenna has a good front-to-back ratio, a relatively high level of cross polarization, and a small envelop correlation coefficient.

4) The antenna has a good independent band-tuning capability. Only by changing two parameters of the antenna, the high-frequency or low-frequency operating frequency bands can be independently tuned, and there exists a high degree of freedom in adjusting a frequency ratio.

Figure 1A:
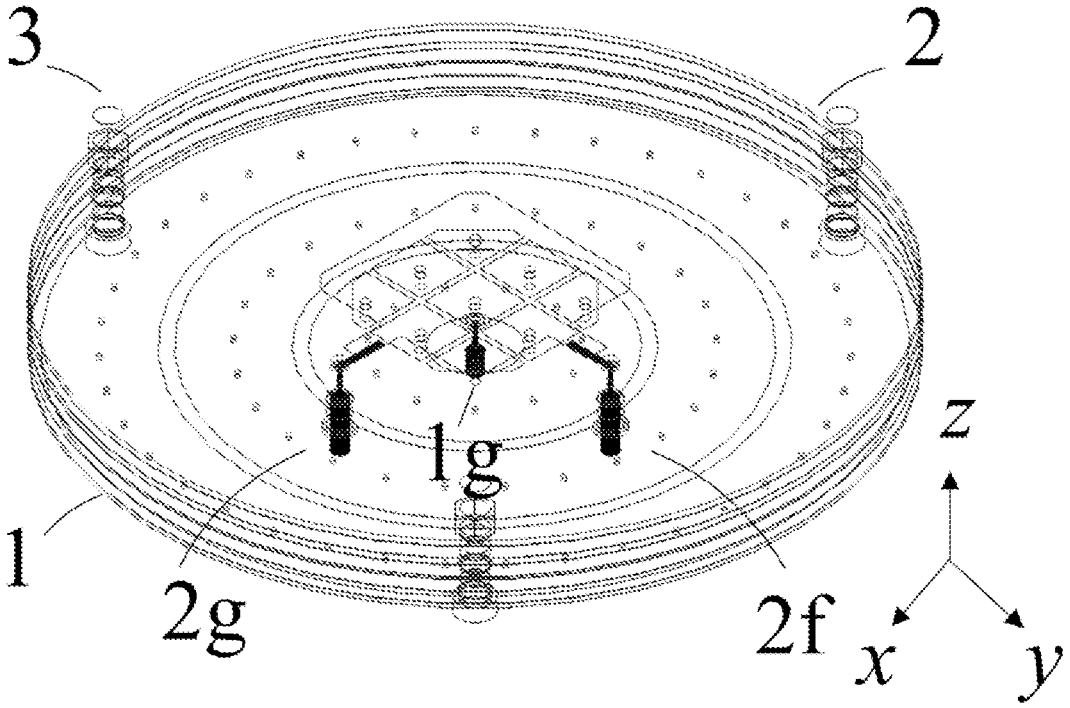
FIG. 1A is a front view of a structure according to the present invention.
Figure 1B:
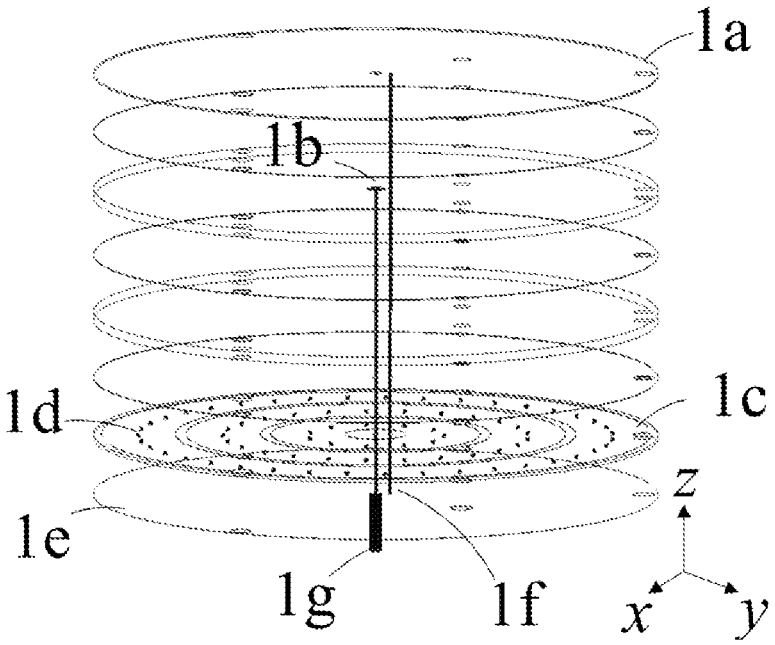
FIG. 1B is an exploded view of a vertically-polarized radiator according to the present invention.
Figure 1C:
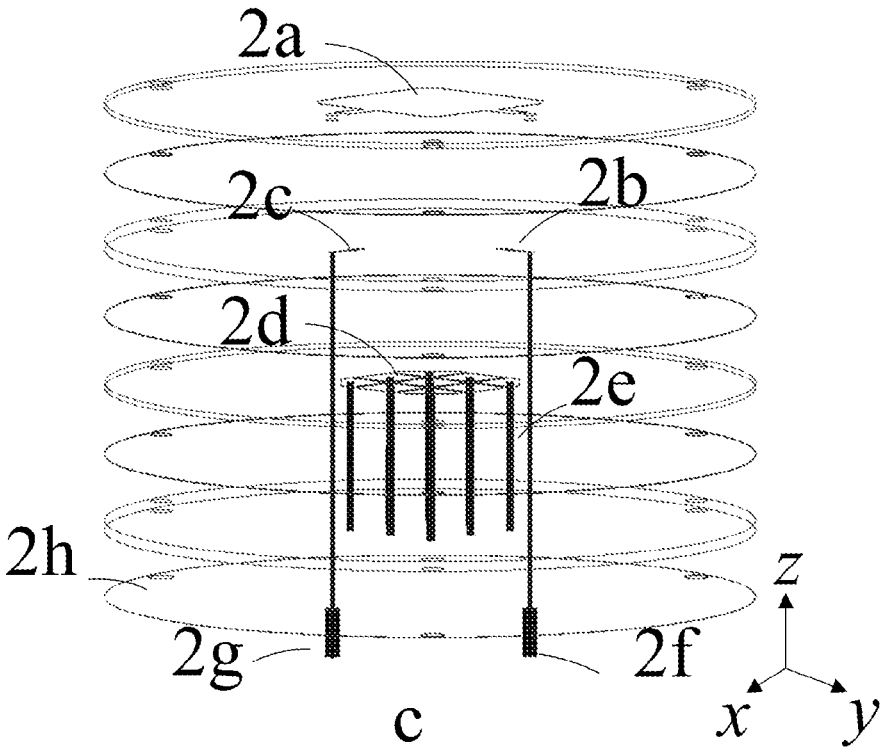
FIG. 1C is an exploded view of a horizontally-polarized radiator according to the present invention.
Figure 1D:
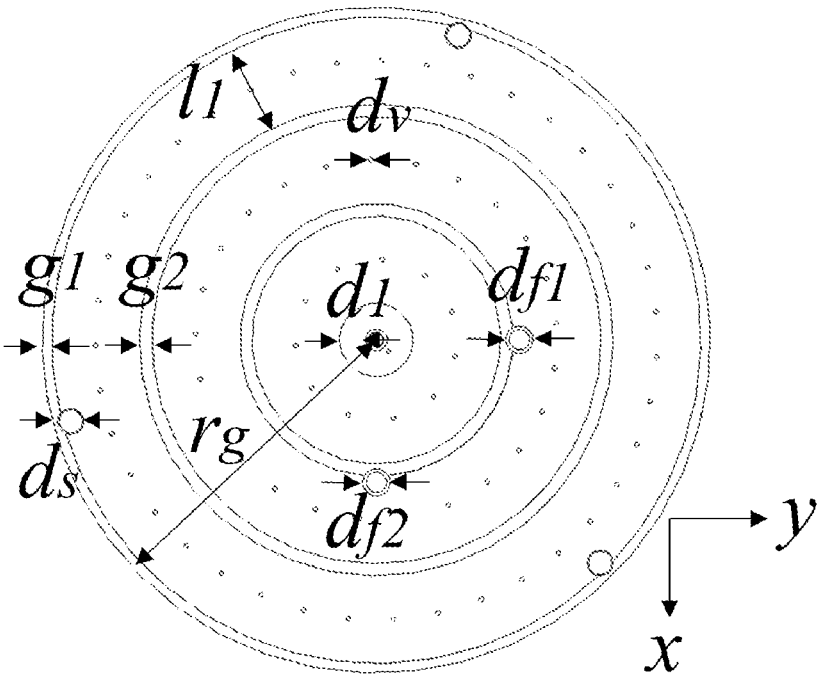
FIG. 1D is a top view of the annular patch array of the vertically-polarized radiator according to the present invention.
Figure 1E:
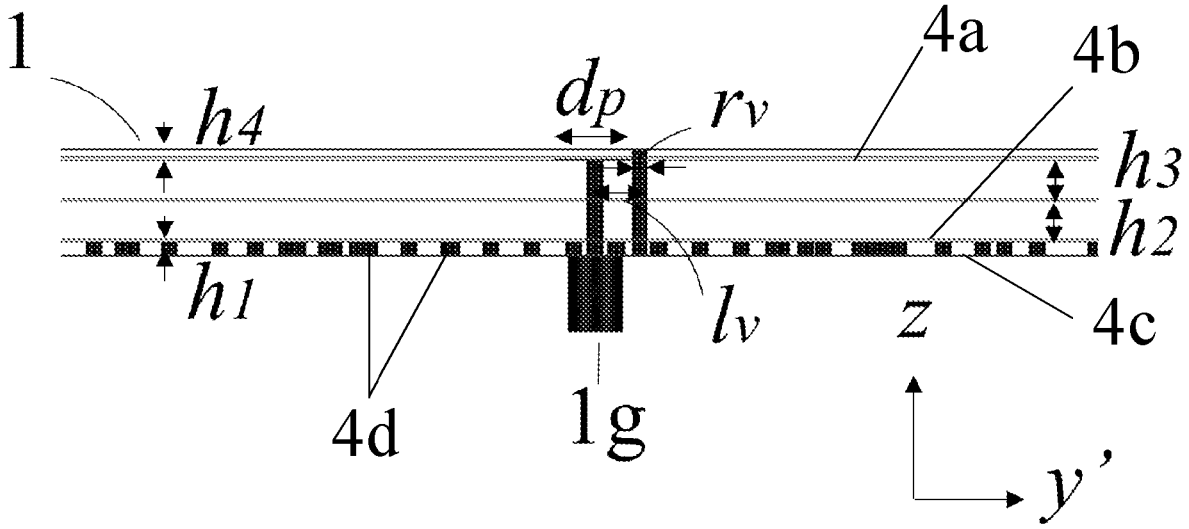
FIG. 1E is a side view of the vertically-polarized radiator according to the present invention.
Figure 1F:
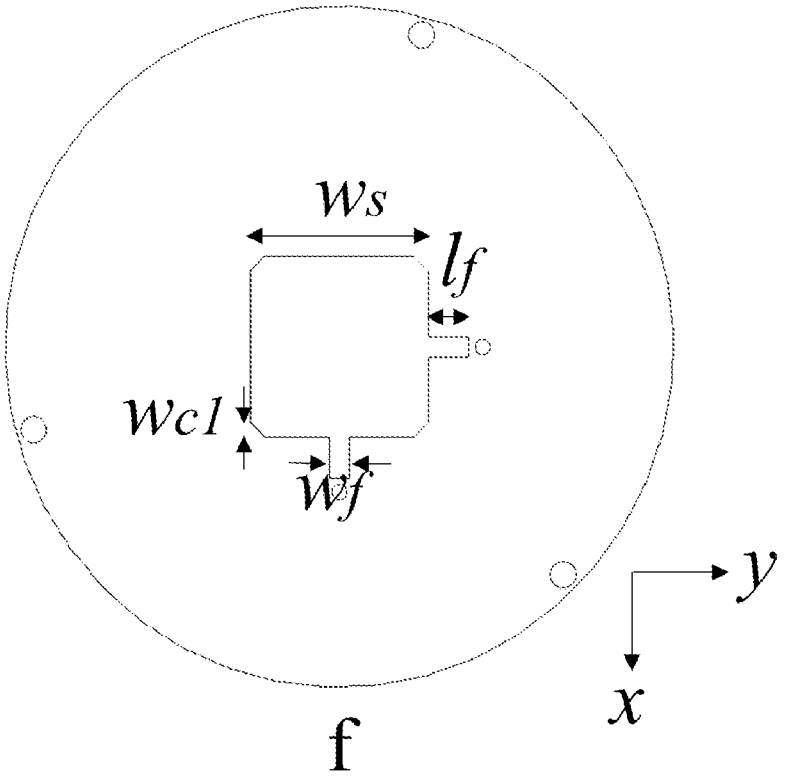
FIG. 1F is a top view of the top patch of a horizontally-polarized radiator according to the present invention.
Figure 1G:
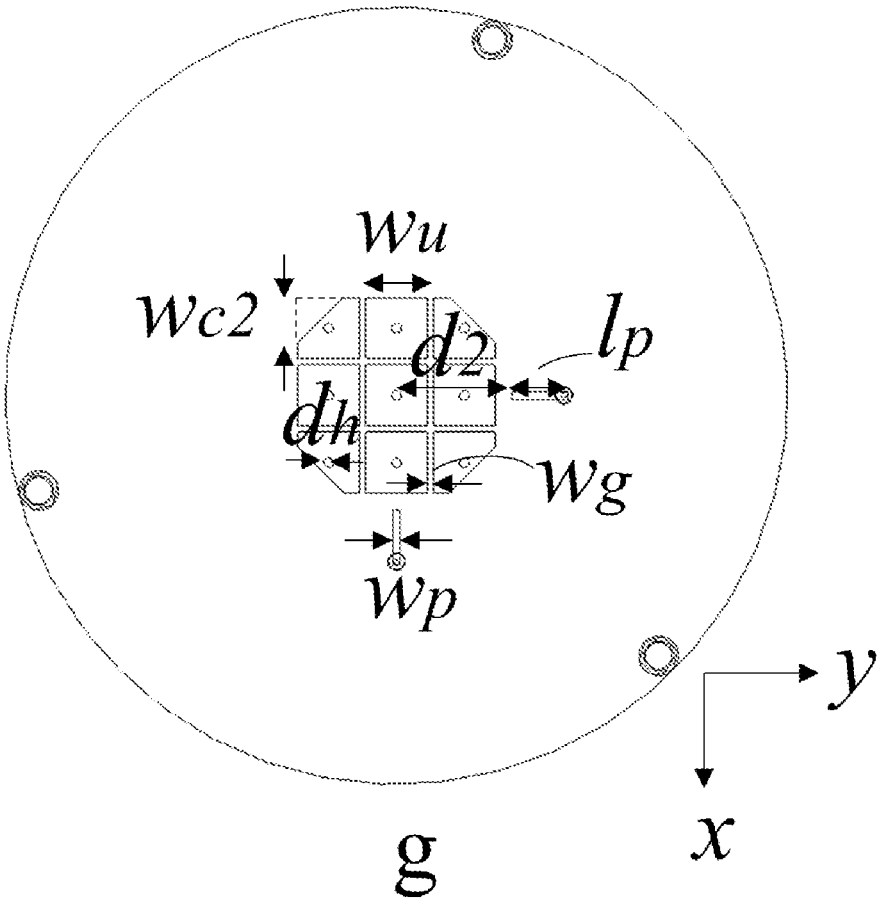
FIG. 1G is a top view of the patch array of the horizontally-polarized radiator according to the present invention.
Figure 1H:
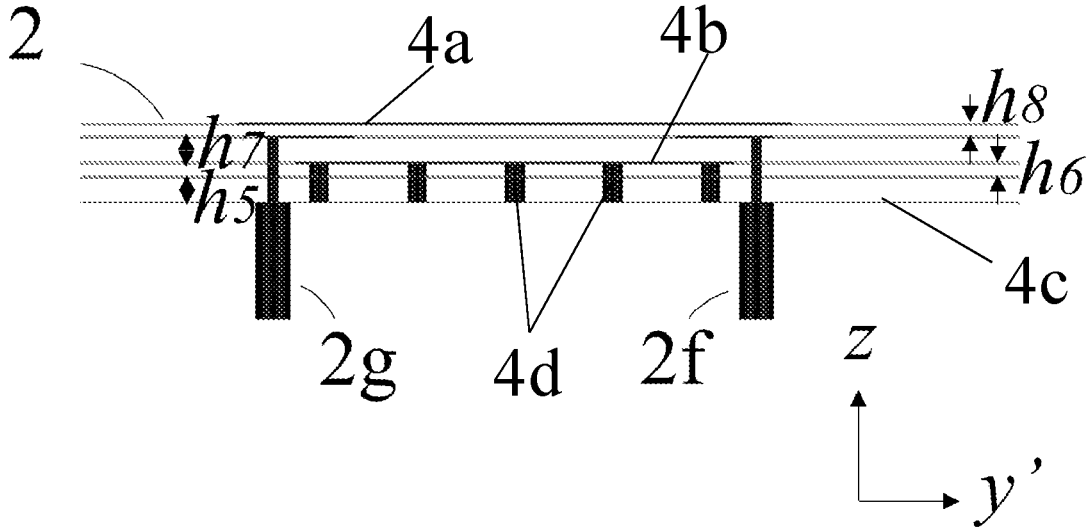
FIG. 1H is a side view of the horizontally-polarized radiator according to the present invention.
Figure 2A:
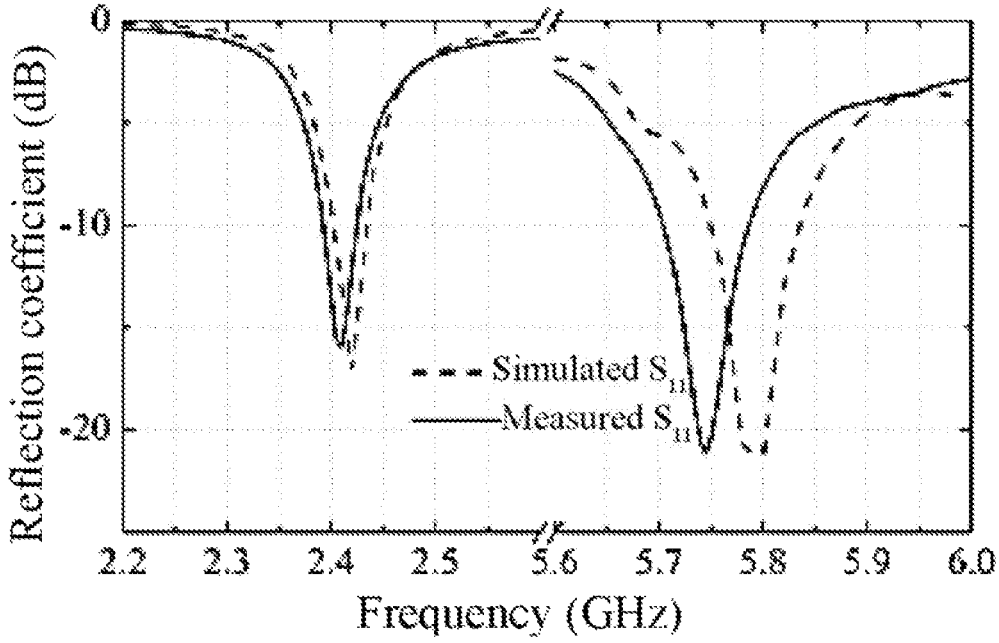
FIG. 2A shows the simulated and measured S-parameters according to the present invention representing the reflection coefficient of the coaxial waveguide port 1.
Figure 2B:
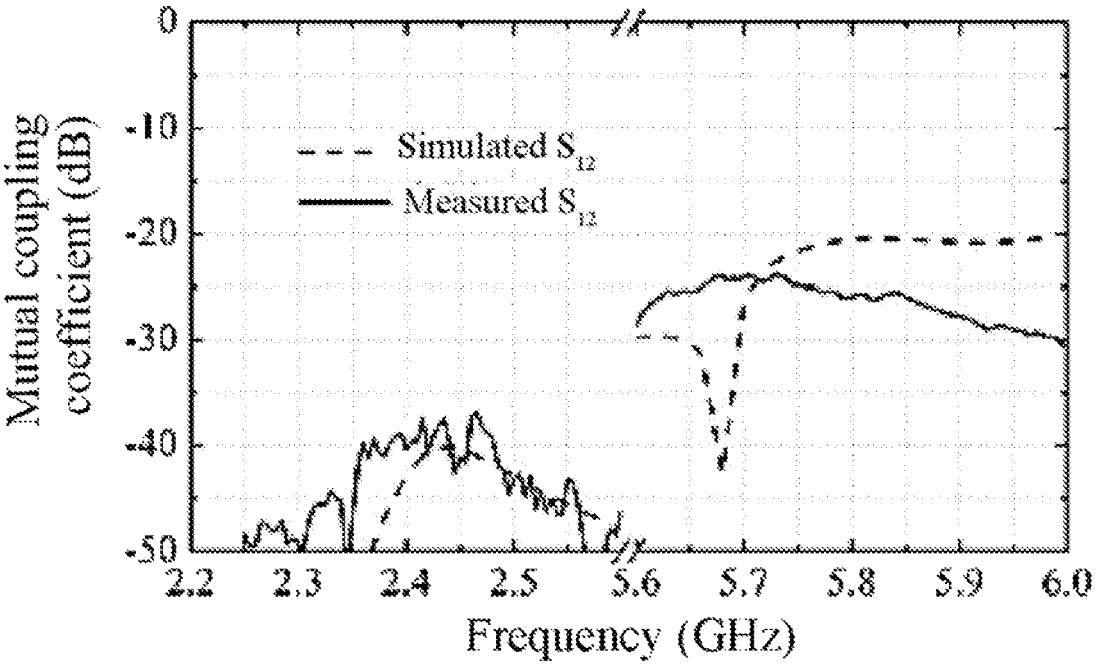
FIG. 2B shows the simulated and measured S-parameters according to the present invention representing the mutual coupling between the coaxial waveguide ports 1 and 2.
Figure 2C:
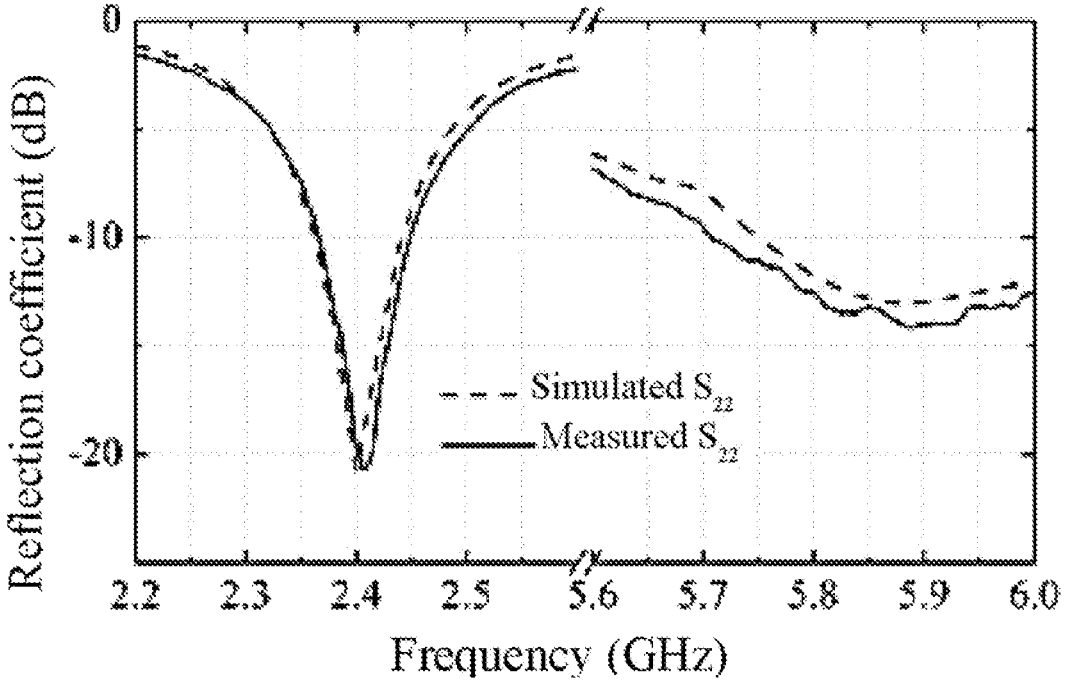
FIG. 2C shows the simulated and measured S-parameters according to the present invention representing the reflection coefficient of the coaxial waveguide port 2.
Figure 2D:
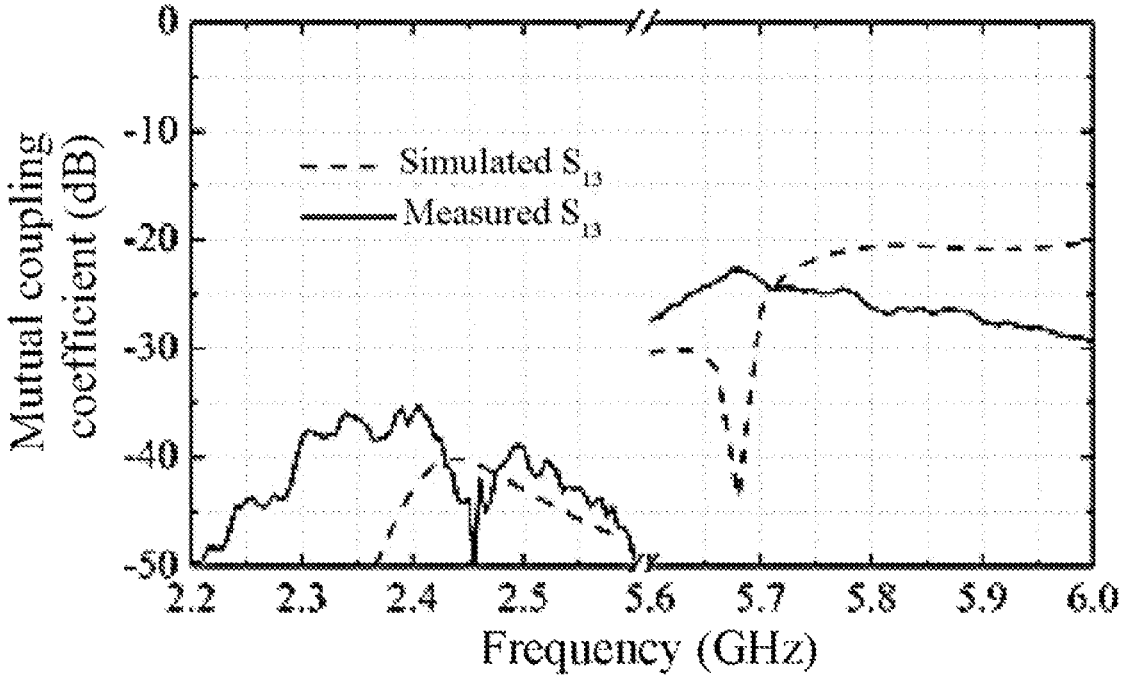
FIG. 2D shows the simulated and measured S-parameters according to the present invention representing the mutual coupling between the coaxial waveguide ports 1 and 3.
Figure 2E:
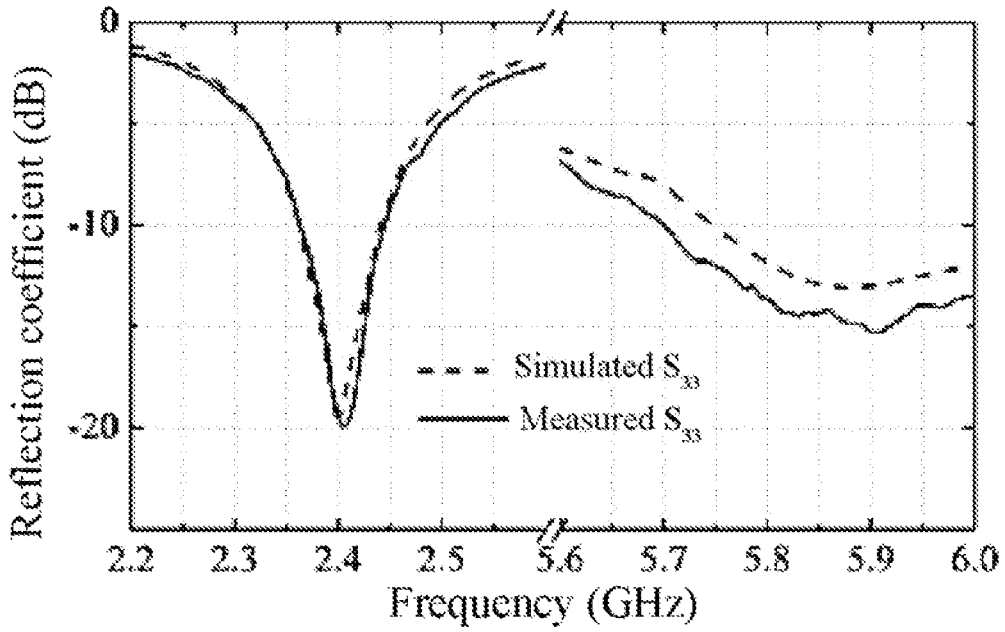
FIG. 2E shows the simulated and measured S-parameters according to the present invention representing the reflection coefficient of the coaxial waveguide port 3.
Figure 2F:
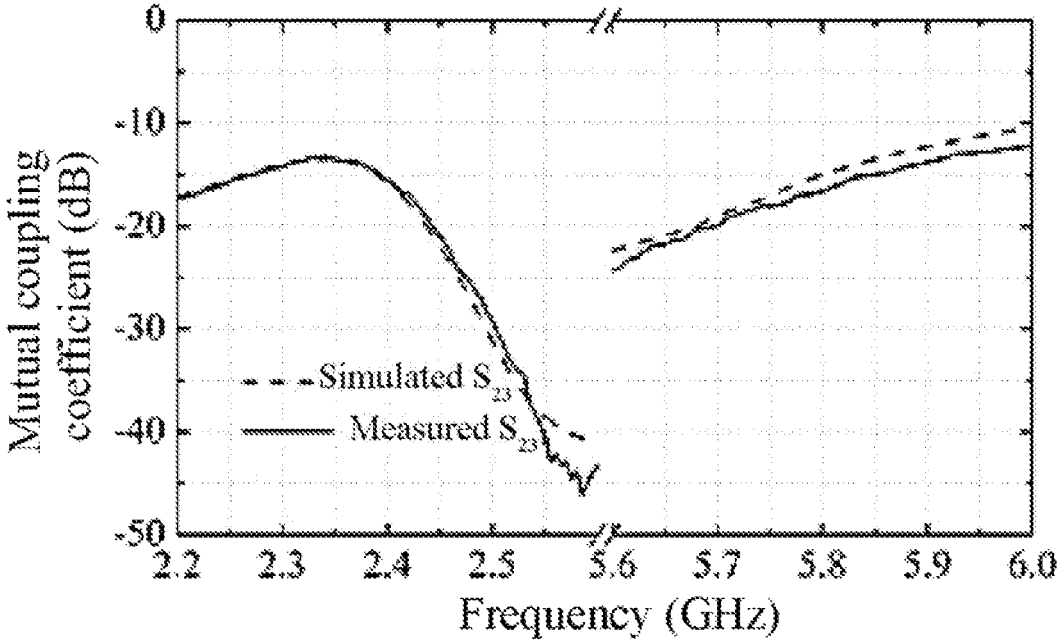
FIG. 2F shows the simulated and measured S-parameters according to the present invention representing the mutual coupling between the coaxial waveguide ports 2 and 3.

1—Vertically-polarized radiator; 1*a*—Top patch of the vertically-polarized radiator; 1*b*—Parasitic disc patch; 1*c*—Annular patch array; 1*d*—Shorting pin ring array; 1*e*—Metal floor of the lower radiator; 1*f*—Shorting pin connecting the top circular patch to the metal floor of the lower radiator; 1*g*—Vertically-polarized coaxial waveguide port (that is, coaxial waveguide port 1); 2—Horizontally-polarized radiator; 2*a*—Top patch of the horizontally-polarized radiator; Microstrips (2*b*, 2*c*) (that is, 2*b*—microstrip loaded by the coaxial waveguide port 2, 2*c*—microstrip loaded by the coaxial waveguide port 3); 2*d*—3×3 square patch array; 2*e*—Shorting pin square array; Horizontally polarized coaxial waveguide ports (2*f*, 2*g*) (that is, 2*f*—coaxial waveguide port 2, 2*g*—coaxial waveguide port 3); 2*h*—Metal floor of the upper radiator;

3—Nylon screw; 4—shielded mushroom structures; 4*a*—first metal layer; 4*b*—second metal layer; 4*c*—third metal layer; 4*d*—metallic shorting pin.

$r_g$—Radius of the metal floor of the lower radiator; $d_p$—Diameter of parasitic disc patch; $l_l$—Patch width of three concentric annular patches having different radii; $d_v$—Diameter of shorting pin ring array; $g_1$—Length of gap between the outer ring of the outermost patch of the three concentric ring patches having different radii and the edge of the dielectric substrate; $g_2$—Length of gap between concentric ring patches; $d_1$—Distance of the inner ring of the innermost patch of three concentric ring patches having different radii from the center; $d_{f1}$—Diameter of a via hole dug at the position of the coaxial waveguide port 2 on the metal floor of the lower radiator and three concentric ring patches having different radii; $d_{f2}$—Diameter of a via hole dug at the position of the coaxial waveguide port 3 on the metal floor of the lower radiator and three concentric ring patches having different radii; $l_v$—Length of the shorting pin connecting the top circular patch to the metal floor of the lower radiator from the center origin; $r_v$—Diameter of the shorting pin connecting the top circular patch to the metal floor of the lower radiator; $w_s$—Side length of the top square patch of the horizontally-polarized radiator; $w_{cl}$—Length of a corner cut from the top square patch; $l_f$—Length of a pair of orthogonal microstrips loaded on the top square patch; $w_f$—Width of a pair of orthogonal microstrips loaded on the top square patch; $w_u$—Side length of a square patch of a patch array; $d_h$—Diameter of the shorting pin square array; $w_{c2}$—Length of a corner cut from the patch array; $w_g$—Length of a gap between the square patches of the patch array; $l_p$—Length of microstrips loaded on the coaxial waveguide ports 2 and 3; $w_p$—Width of microstrips loaded on the coaxial waveguide ports 2 and 3; $d_2$—Length of inner ends of the microstrips loaded at the coaxial waveguide ports 2 and 3 from the center; $d_s$—Diameter of screw hole; $h_1$—Thickness of the lowermost dielectric substrate of the dual-band triple-polarized antenna based on shielded mushroom structures 4; $h_2$—Thickness of a last but one layer of the dielectric substrate of the dual-band triple-polarized antenna based on shielded mushroom structures 4; $h_3$—Thickness of a last but two layer of the dielectric substrate of the dual-band triple-polarized antenna based on shielded mushroom structures 4; $h_4$—Thickness of a last but three layer of the dielectric substrate of the dual-band triple-polarized antenna based on shielded mushroom structures 4; $h_5$—Thickness of a last but four layer of the dielectric substrate of a dual-band triple-polarized antenna based on shielded mushroom structures 4; $h_6$—Thickness of a last but five layer of the dielectric substrate of the dual-band triple-polarized antenna based on shielded mushroom structures 4; $h_7$—Thickness of a last but six layer of the dielectric substrate of the dual-band triple-polarized antenna based on shielded mushroom structures 4; $h_8$—Thickness of a top layer of the dielectric substrate of the dual-band triple-polarized antenna based on shielded mushroom structures 4.

DETAILED DESCRIPTION OF THE EMBODIMENTS

The following further describes the present invention in detail with reference to the accompanying drawings.

As shown in FIGS. 1A-1H, a dual-band triple-polarized antenna based on shielded mushroom structures 4 in the present invention includes a vertically-polarized radiator 1 and a horizontally-polarized radiator 2. The horizontally-polarized radiator 2 is located above the vertically-polarized radiator 1, and both of them are fixed by nylon screws 3. The vertically-polarized radiator 1 and the horizontally-polarized radiator 2 include a plurality of shielded mushroom structures 4 shown in FIG. 7, respectively. The shielded mushroom cell structure each includes at least three metal layers 4*a*-4*c* and a metallic shorting pin 4*d*. The shorting pin connects at least two of the metal layers.

A coaxial waveguide ports 2 and 3 of the horizontally-polarized radiator 2 pass through the vertically-polarized radiator 1, and the top patch of the vertically-polarized radiator 11*a* is electrically connected to the metal floor of the upper radiator of the horizontally-polarized radiator 2 2*h*. The vertically-polarized radiator 1 includes in sequence from the top to bottom: a top circular patch 1*a* (in this embodiment, the top patch of the vertically-polarized radiator 1*a* is a circular patch, which is referred to as the top circular patch 1*a* below), a parasitic disc patch 1*b*, an annular patch array 1*c*, a shorting pin ring array 1*d*, and a metal floor of the lower radiator 1*e*. The shorting pin ring array 1*d* is connected to the annular patch array 1*c* and the metal floor of the lower radiator 1*e*. For the annular patch array 1*c* in this embodiment, three concentric ring patches having different radii are selected as the annular patch array 1*c*. The number of the concentric ring patches not limited to 2-5 concentric ring patches having different radii can be also chosen. The number of patches is adjusted according to actual size requirements. Alternatively, a plurality of small patches can be selected to constitute each annular patch. The feeding structure of the vertically-polarized radiator 1 includes a coaxial waveguide port 1 (reference numeral 1*g*) connected to the parasitic disc patch 1*b* between the top circular patch 1*a* and the annular patch array 1*c*, and located in the center of the vertically-polarized radiator 1 for coupled feed. The horizontally-polarized radiator 2 includes in sequence from the top to bottom: a top square patch loaded by microstrips 2*a*, a microstrip loaded on the coaxial waveguide port 22*b*, a microstrip loaded on the coaxial waveguide port 32*c*, a 3×3 square patch array 2*d* (in this embodiment, the patch array 2*d* is a 3×3 square patch array, which is referred to as a 3×3 square patch array 2*d* below), a shorting pin square array 2*e*, and a metal floor of the upper radiator 2*h*. The shorting pin square array 2*e* is connected to the 3×3 square patch array 2*d* and the metal floor of the upper radiator 2*h*. The feeding structure of the horizontally-polarized radiator 2 includes a microstrip loaded on the coaxial waveguide port 22*b*, a microstrip loaded on the coaxial waveguide port 32*c*, a coaxial waveguide port 2 (2*f*), and a coaxial waveguide port 3 (2*g*). The microstrip loaded on the coaxial waveguide port 2 2*b* and the microstrip loaded on the coaxial waveguide port 3 2*c* are coupled with the top square patch loaded by microstrips 2*a* for coupled feeding. The coaxial waveguide port 3 (2*g*) is formed by rotating the coaxial waveguide port 2 (2*f*) around z-axis by 90 degrees.

In this embodiment, in order to achieve dual-band multi-mode radiation characteristics, and considering that a horizontally-polarized radiator should be placed above a vertically-polarized radiator, in the premise of a compact structure for two radiators, the top circular patch is designed as a shielded design.

In order to achieve the above design requirements, the present invention adopts shielded mushroom structures 4. By controlling the dispersion properties of a shielded mushroom cell structure, the dispersion properties of the cell can respectively meet resonance conditions for vertical polarization and horizontal polarization at 2.4 GHz and 5.8 GHz, and then two radiator structures having different radiation characteristics are formed. Therefore, according to the present invention, an antenna with dual-band triple-polarized radiation characteristics can be designed based on the same cell structure.

In the design of the vertically-polarized radiator, for generating a vertically-polarized omnidirectional radiation pattern in a thinner circular patch structure, the main radiation mode is a φ-invariant transverse magnetic wave mode (TM mode). In order to excite the $TM_{02}$ mode at 2.4 GHz and $TM_{03}$ mode at 5.8 GHz to achieve the dual-band vertically-polarized omnidirectional radiation pattern, the total phase shifts along the p-direction at two frequencies should be equal to the second and third roots of the derivative of the zeroth-order Bessel function of the first kind, that is, 220° and 402°. In the p-direction, the vertically-polarized radiator contains three shielded mushroom structure 4 cells and a section of 5 mm-long parallel plate wave guide. The phase shifts of the parallel plate waveguide at two frequencies are 21° and 51°, so that the phase shifts of the shielded mushroom cell structure at the two frequencies should be designed as 66° and 117°. For the feeding structure, the method of a coaxial waveguide port feeding in the center is adopted in the invention. Due to the impedance mismatch, a parasitic disc patch is loaded on the top of the coaxial cable to enable a capacitive coupling with the top circular patch, and then a metallic shorting pin 4*d* connecting the top circular patch to the metal floor of the lower radiator is loaded in the vicinity of the central coaxial waveguide port with a distance of about 0.02 $\lambda_0$ in a direction with φ=45° for inductive tuning.

In the design of the horizontally-polarized radiator, in order to generate dual horizontal polarization, the antenna adopts a symmetrical rectangular radiator structure. In order to construct the $TM_{01}$ and $TM_{10}$ modes in a rectangular cavity, the total phase shifts of the radiator along the x- and y-axis should be equal to 180°, and therefore for three isotropic shielded mushroom structures 4 along x- and y-axis, the phase shift of each cell should be equal to 60°. In this way, a symmetrical cell structure can be used to constitute a radiator with dual horizontally-polarized broadside radiation pattern along x- and y-axis. For the feeding structure, the coaxial waveguide ports 2 and 3 adopt the form of L-shaped probes, that is, two microstrips are loaded on the top of a coaxial waveguide cables, and the microstrips are also loaded on the top square patch. In this way, the microstrips loaded on the coaxial waveguide ports and the top square patch can generate a capacitive coupling effect, and the microstrips loaded on the top square patch canals to provide an inductive effect. By jointly adjusting the microstrips and the top square patch, the impedance matching of the radiator has been significantly improved. The improvement of the port isolation between the coaxial waveguide port 1 and the coaxial waveguide ports 2 and 3 can be designed from two aspects. On one hand, the positions of the coaxial waveguide ports 2 and 3 should locate near the field nulls of the operating modes of the vertically-polarized radiator. On the other hand, the metal floor of the lower radiator is used as the ground of the coaxial waveguide ports 2 and 3, and then the top circular patch is electrically connected to the metal floor of the upper radiator, so as to separate the ground from the ground of the coaxial waveguide port 1. Consequently, the port isolation between the coaxial waveguide port 1 and the coaxial waveguide ports 2 and 3 can be increased from 10 dB to 42 dB at 2.4 GHz and from 16 dB to 20 dB at 5.8 GHz. In addition, it also contributes to an increase in the port isolation between the coaxial waveguide ports 2 and 3, especially an increase from 8 dB to 15 dB at 5.8 GHz.

For the improvement of the port isolation between the coaxial waveguide ports 2 and 3, cutting the corners from the top square patch and the 3×3 square patch array can increase the port isolation at 5.8 GHz from 8.7 dB to 15 dB and conversely reduce the port isolation at 2.4 GHz from 26 dB to 15.5 dB. Obviously, the port isolation at the two frequencies have already met the requirements for the isolation in a multi-input multi-output antenna. There are two reasons for improving the port isolation by cutting corners from the top square patch and the 3×3 square patch array. First, when the corners are not cut, the resonant frequency of the antenna is lower than 5.8 GHz, which results in a higher mutual coupling at 5.8 GHz. When the corners are cut from the two-layer patches, the operating band shifts to a higher frequency due to the smaller size of the radiator. Such a band shift causes that the peak value of mutual coupling also shifts to a high frequency, thereby reducing the mutual coupling within the operating frequency band. Secondly, when the coaxial waveguide port 2 is activated, it can be found on the top square patch that strong currents flow along the x-axis, which would interfere with the co-polarized currents along the y-axis. When the corners are cut, the strength of the x-polarized currents is getting significantly weaker, so that the interference on the y-polarized currents is greatly reduced. FIG. 1A, FIG. 1B, FIG. 1C, FIG. 1D, FIG. 1E, FIG. 1F, and FIG. 1G show the top view, front view, and side views of the dual-band triple-polarized antenna based on shielded mushroom structures 4. The antenna has a radius of $0.39\lambda_0$, and a total thickness of $0.07\lambda_0$, where $\lambda_0$ is the wavelength at 2.4 GHz in free space. Among them, the y'-axis is formed by rotating the y-axis 45° counterclockwise around the z-axis.

FIGS. 2A-2F show the simulated and measured S-parameters of the dual-band triple-polarized antenna based on shielded mushroom structures 4. It can be concluded from the results that the antenna has bandwidths of 35 MHz at 2.4 GHz and 85 MHz at 5.8 GHz, respectively. The antenna can also achieve the sharing of the vertically-polarized omnidirectional patterns and the dual-horizontally-polarized broadside patterns, and a port isolation of greater than 15 dB between each port.

Figure 3A:
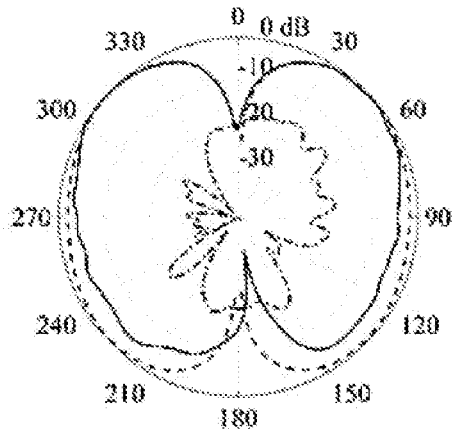
FIG. 3A shows the simulated and measured normalized far-field radiation patterns in free space at 2.4 GHz according to the present invention when the coaxial waveguide port 1 is excited.
Figure 3A:
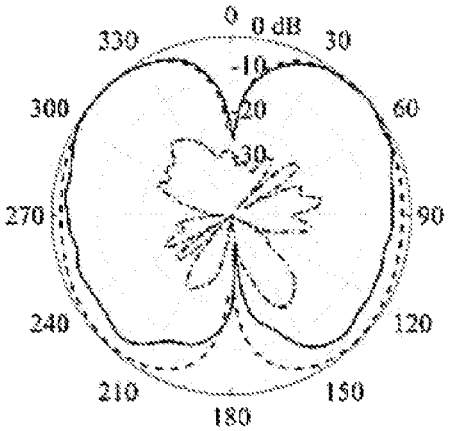
Figure 3A:
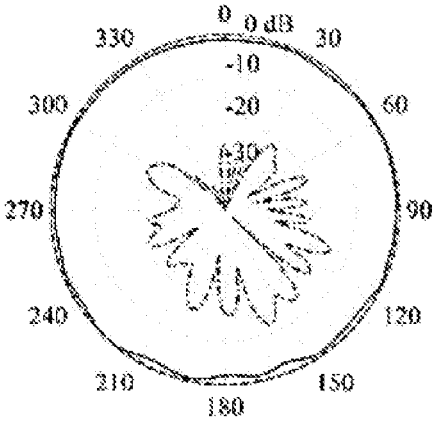
Figure 3B:
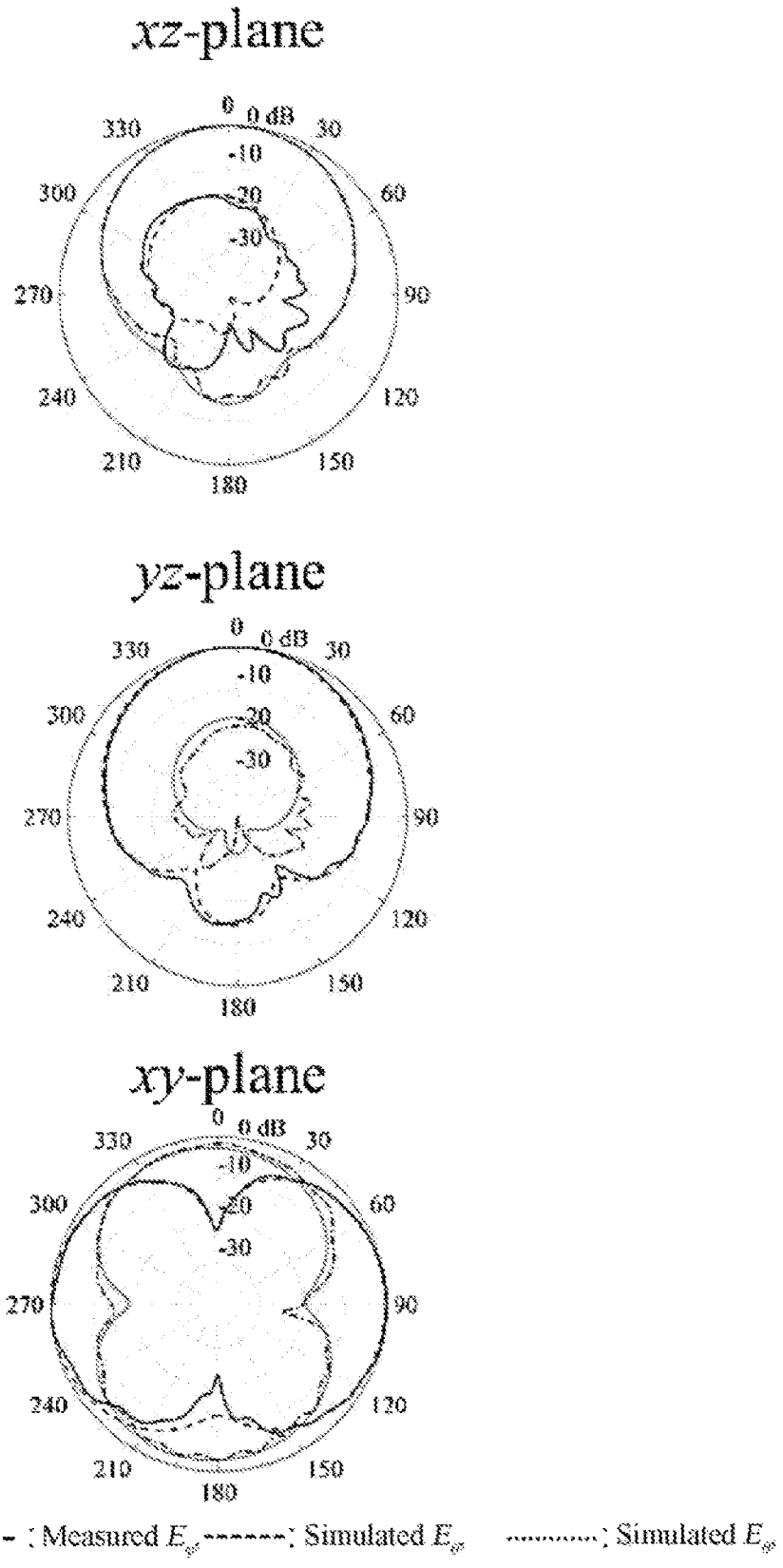
FIG. 3B shows the simulated and measured normalized far-field radiation patterns in free space at 2.4 GHz according to the present invention, when the coaxial waveguide port 2 is excited.
Figure 3C:
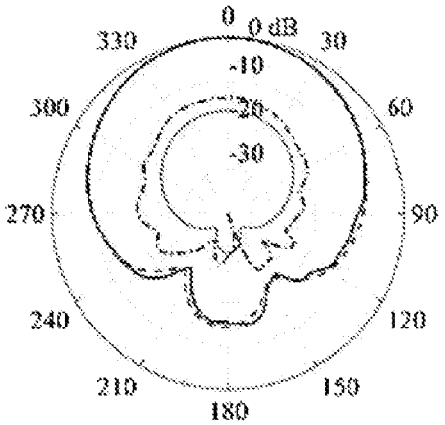
FIG. 3C shows the simulated and measured normalized far-field radiation patterns in free space at 2.4 GHz according to the present invention, when the coaxial waveguide port 3 is excited.
Figure 3C:
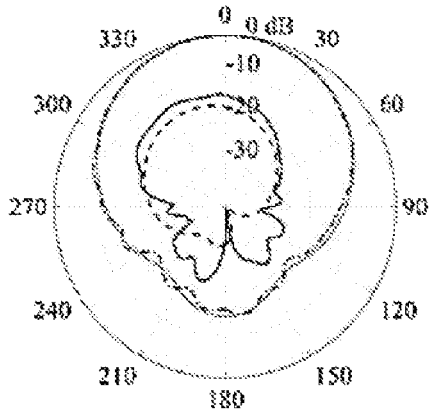
Figure 3C:
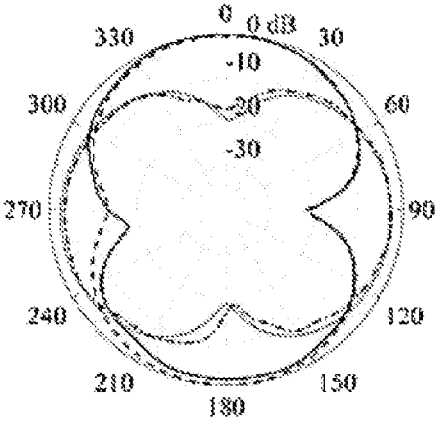
Figure 4A:
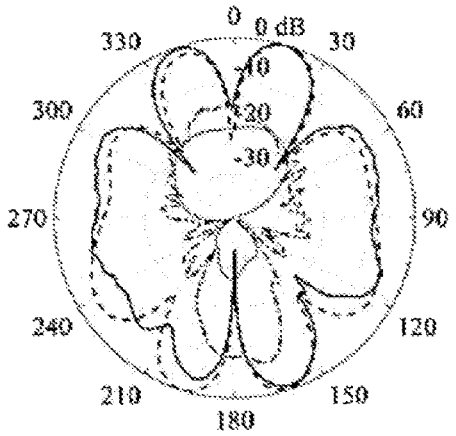
FIG. 4A shows the simulated and measured normalized far-field radiation patterns in free space at 5.8 GHz when the coaxial waveguide port 1 is excited.
Figure 4A:
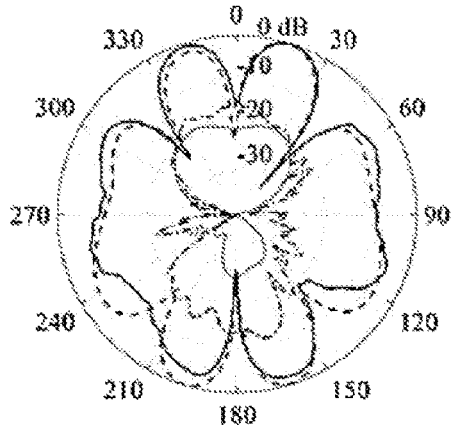
Figure 4A:
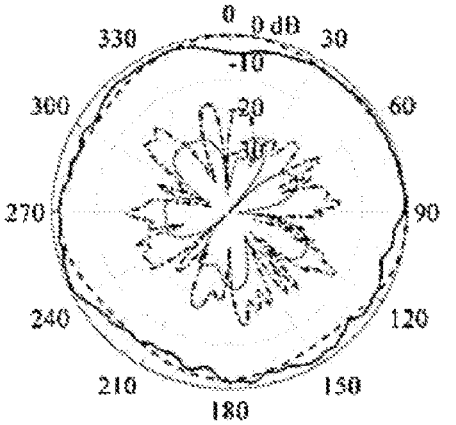
Figure 4B:
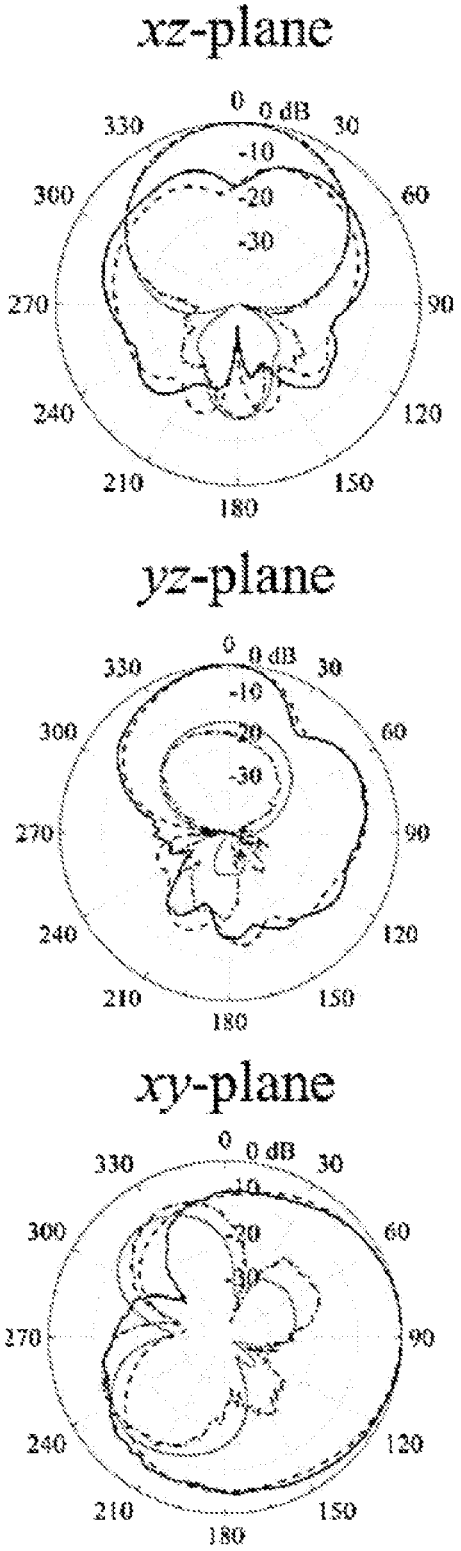
FIG. 4B shows the simulated and measured normalized far-field radiation patterns in free space at 5.8 GHz, when the coaxial waveguide port 2 is excited.
Figure 4C:
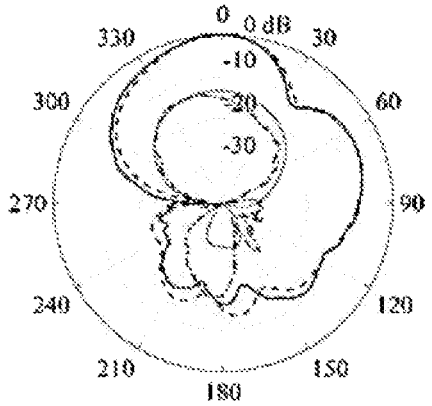
FIG. 4C shows the simulated and measured normalized far-field radiation patterns in free space at 5.8 GHz, when the coaxial waveguide port 3 is excited.
Figure 4C:
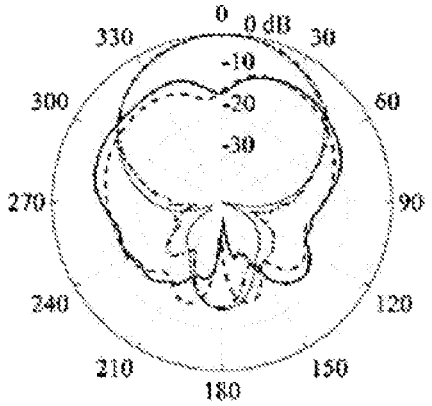
Figure 4C:
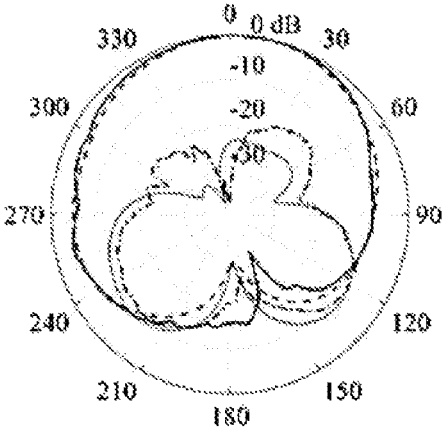
Figure 5:
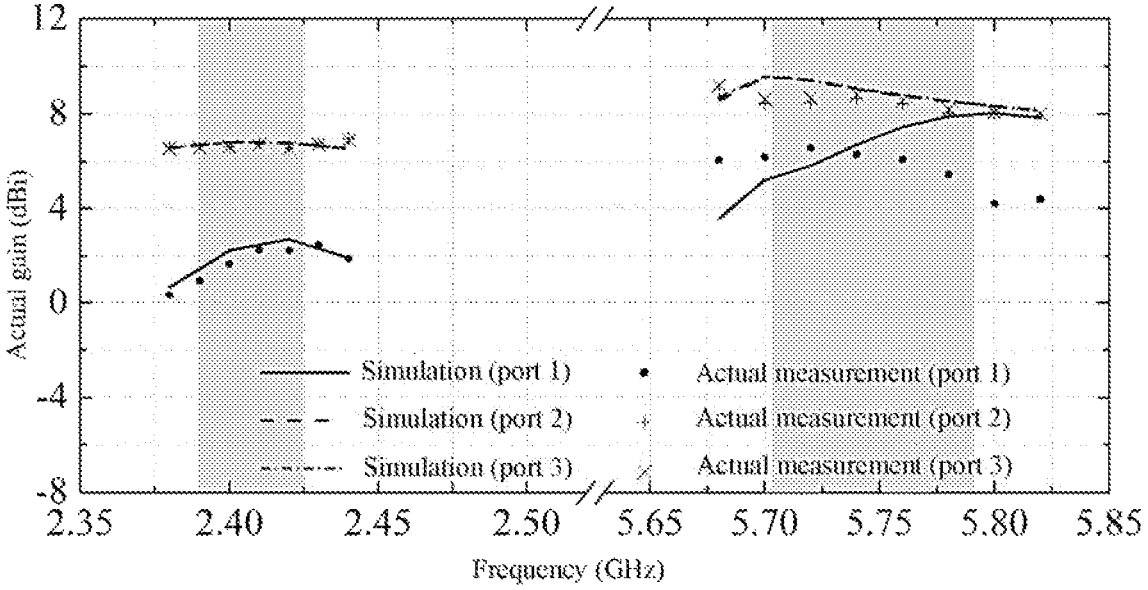
FIG. 5 shows variation curves of gains versus frequencies in free space.

FIGS. 3A-3C show the simulated and measured normalized far-field radiation patterns of the dual-band triple-polarized antenna based on shielded mushroom structures 4 in a free space at 2.4 GHz, where FIG. 3A is a pattern when the coaxial waveguide port 1 is excited, FIG. 3B is a pattern when the coaxial waveguide port 2 is excited, and FIG. 3C is a pattern when the coaxial waveguide port 3 is excited. It can be concluded from the results that the measured results agree well with the simulated. When the coaxial waveguide port 1 is excited, an omnidirectional pattern with the gain fluctuation of only 0.25 dB can be achieved. When the coaxial waveguide ports 2 and 3 are respectively excited, directional patterns with the half-power beam widths of 86° and 80° in the yz- and xz-planes can be realized. A front-to-back ratio of the measured pattern is greater than 14.5 dB, and a cross polarization is also less than −16.7 dB. FIGS. 4A-4C show the simulated and measured normalized far-field radiation patterns of the dual-band triple-polarized antenna based on shielded mushroom structures 4 in free space at 5.8 GHz, where FIG. 4A is a pattern when the coaxial waveguide port 1 is excited, FIG. 4B is a pattern when the coaxial waveguide port 2 is excited, and FIG. 4C is a pattern when the coaxial waveguide port 3 is excited. It can be concluded from the results that good agreement is obtained between the simulated and measured results. When the coaxial waveguide port 1 is excited, an omnidirectional pattern with the gain fluctuation of 5 dB is achieved. When the coaxial waveguide ports 2 and 3 are respectively excited, directional patterns with the half-power beam widths of 47° and 59° in the yz- and xz-planes can be obtained. A front-to-back ratio of the measured pattern is greater than 14.5 dB, and a cross polarization is less than −13.7 dB. FIG. 5 shows the simulated and measured realized gains of the dual-band triple-polarized antenna based on shielded mushroom structures 4 in free space. The results show that the simulated and measured realized gains agree well with each other. When the coaxial waveguide ports 1/2/3 is excited, the antenna achieves a realized gain of 2.3/6.8/6/7 dBi in the low frequencies, and 6.6/9.0/9.2 dBi in the high frequencies. The gain fluctuation in the high frequencies is mainly caused by the frequency shift of less than 1% and radiation from the induced currents on the coaxial cables.

Figure 6A:
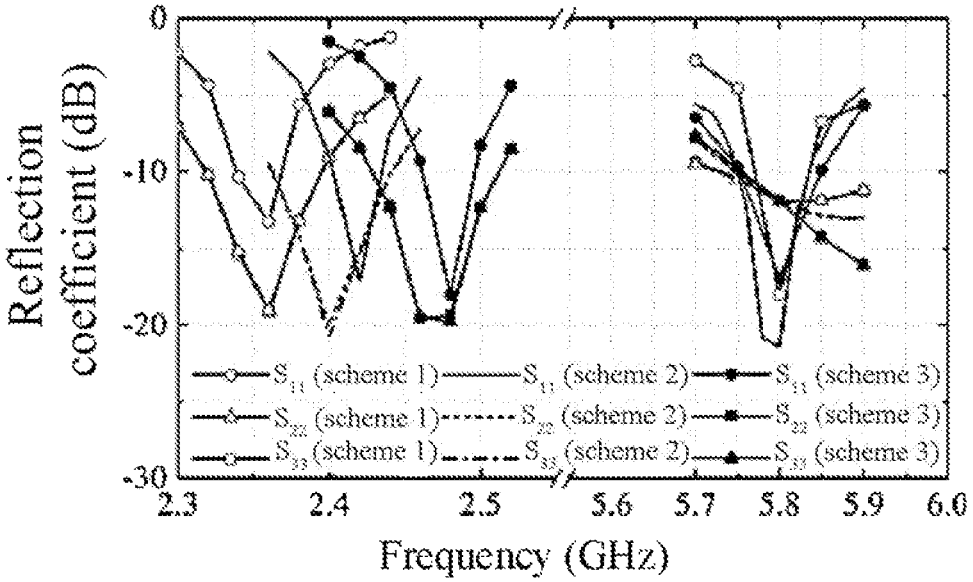
FIG. 6A shows the independent adjustment of S-parameters in the low and high frequency bands representing the reflection coefficient of each coaxial waveguide port when the low frequency band is independently adjustable.
Figure 6B:
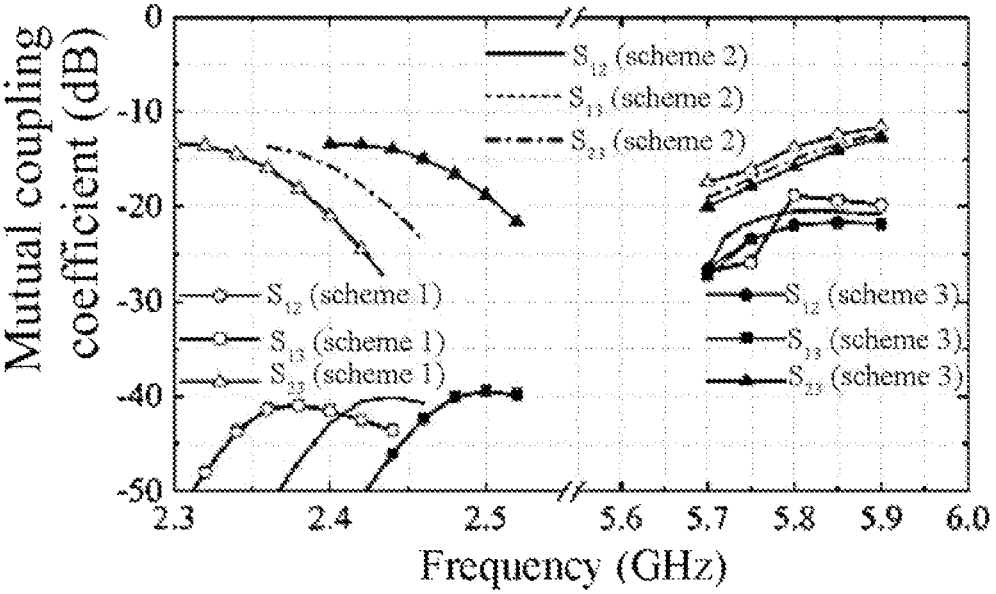
FIG. 6B shows the independent adjustment of S-parameters in the low and high frequency bands, representing the mutual coupling between each coaxial waveguide port when the low frequency band is independently adjustable.
Figure 6C:
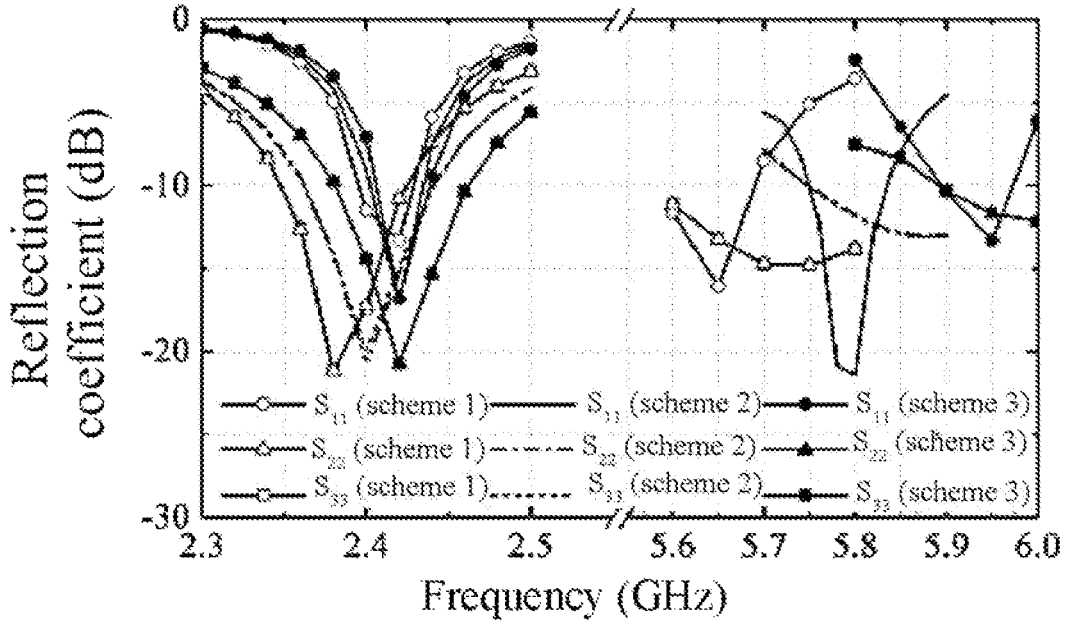
FIG. 6C shows the independent adjustment of S-parameters in the low and high frequency bands, representing the reflection coefficient of each coaxial waveguide port when the high frequency band is independently adjustable.
Figure 6D:
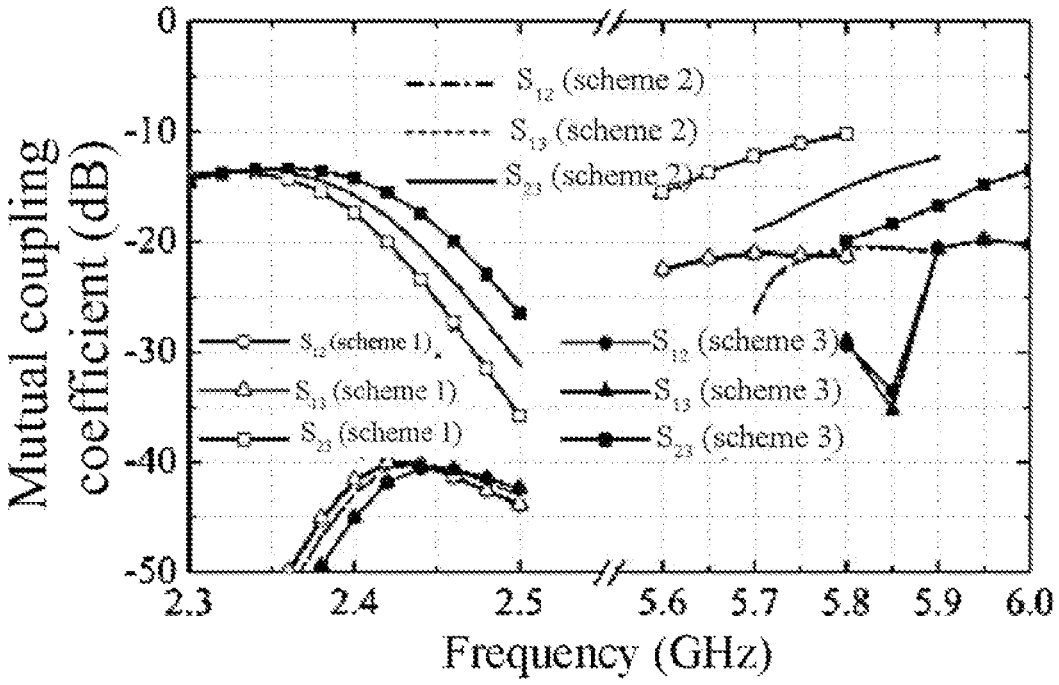
FIG. 6D shows the independent adjustment of S-parameters in the low and high frequency bands, representing the mutual coupling between each the coaxial waveguide port when the high frequency band is independently adjustable; Case1 is the frequency band shifting to the low band, Case2 is the frequency band unchanged, and Case3 is the frequency band shifting to the high frequency.

FIGS. 6A-D show the independent adjustment of S-parameters in the low and high frequency bands, where FIG. 6A represents the reflection coefficients when the low frequency band is independently adjustable, FIG. 6B represents the mutual couplings when the low frequency band is independently adjustable, FIG. 6C represents the reflection coefficients when the high frequency band is independently adjustable, and FIG. 6D represents the mutual couplings when the high frequency band is independently adjustable. Case 1 is the frequency band shifting to the low frequency, Case 2 is to the frequency band unchanged, and Case 3 is the frequency band shifting to the high frequency. When the diameter of the shorting pin ring array or the shorting pin square array is changed, the frequency band at 5.8 GHz would shift towards the low frequency or high frequency, while the frequency band at 2.4 GHz remains unchanged. When the diameter of the shorting pin ring array or the shorting pin square array and the patch widths of the annular patch array or square patch side lengths of the square array are jointly changed, the frequency band at 2.4 GHz would shift to the low or high frequencies, while the frequency band at 5.8 GHz remains unchanged. Moreover, whether the frequency band at 2.4 GHz or 5.8 GHz is adjusted, a high port isolation can also be achieved.

Figure 7:
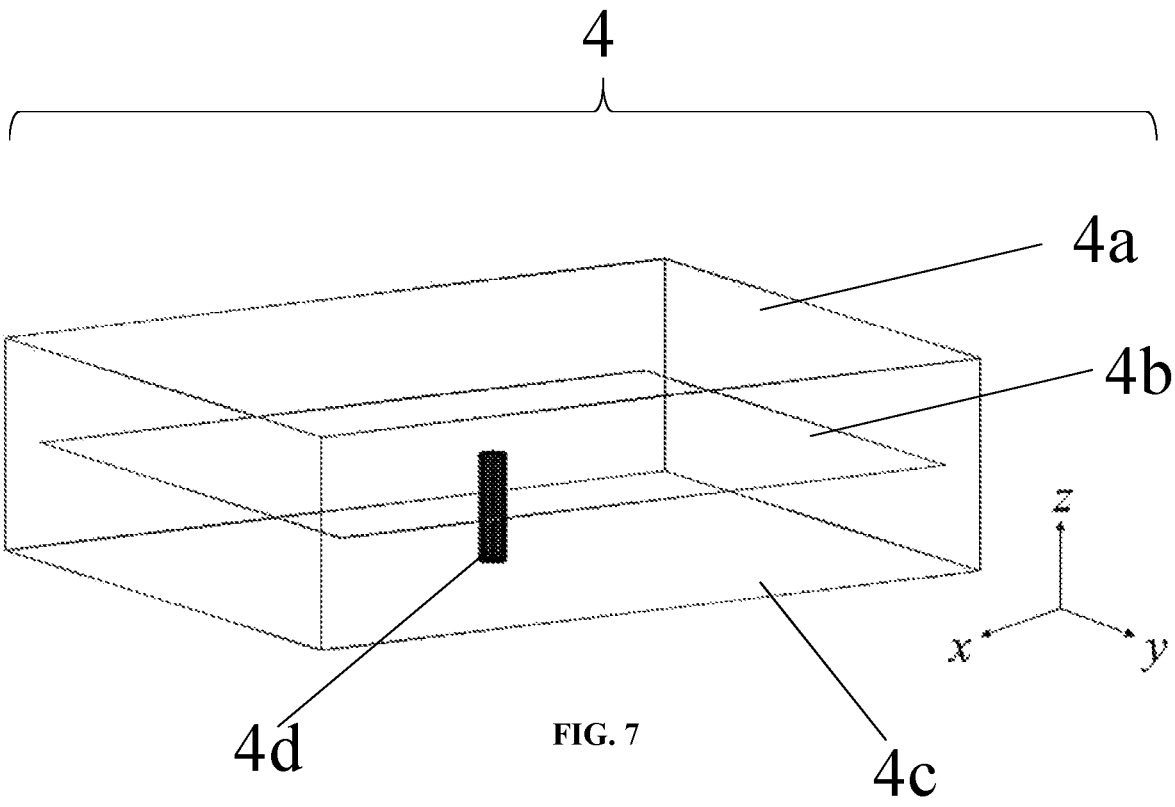
FIG. 7 is a schematic diagram of the shielded mushroom cell structure.

FIG. 7 depicts the configuration of the shielded mushroom cell structure, which is comprised by three metal layers 4*a*-4*c* and a metallic shorting pin 4*d*. The shorting pin connects the bottom metal layer and middle metal layer.

Figure 8A:
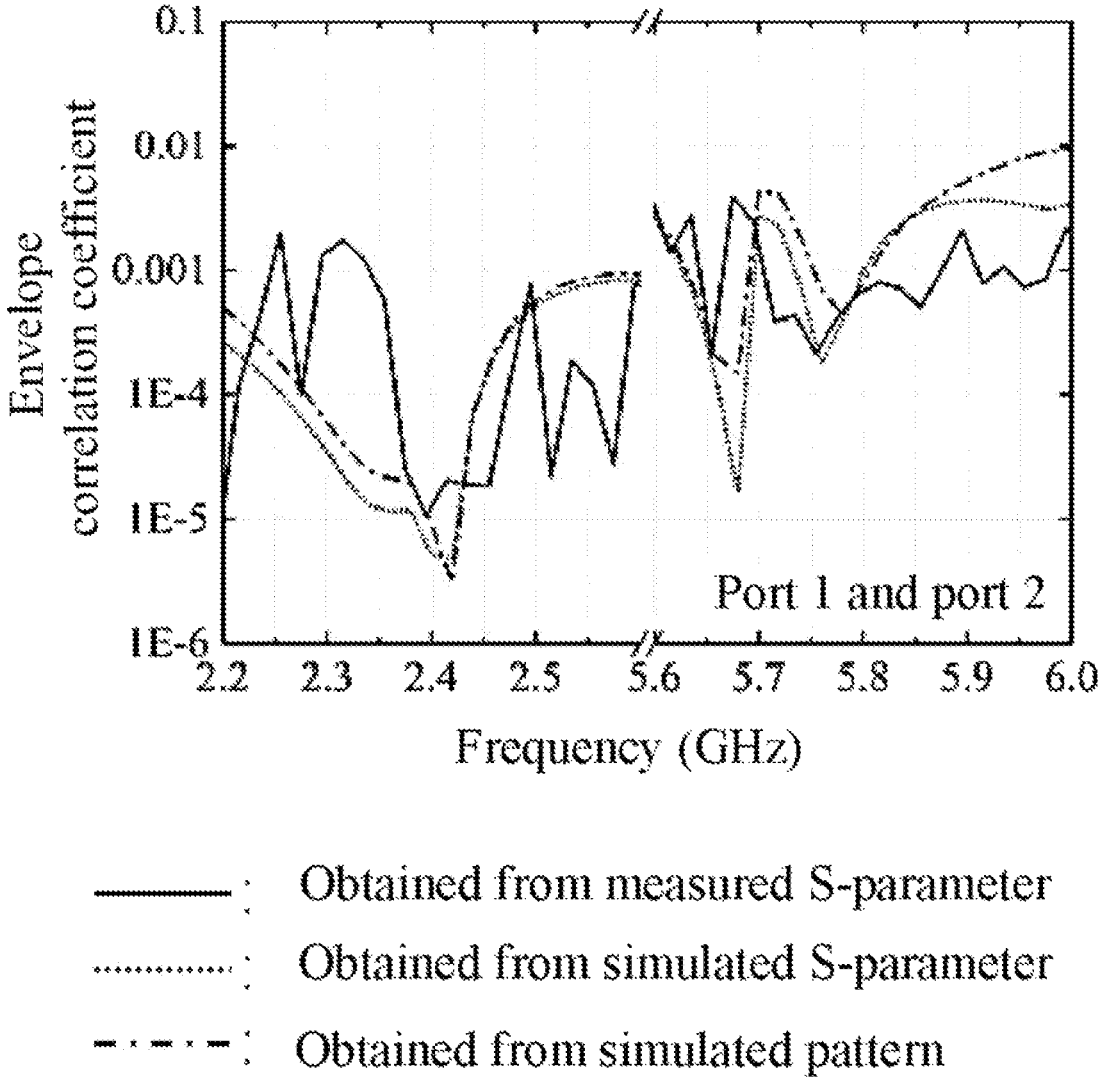
FIG. 8A shows envelope correlation coefficients between three ports, representing the envelope correlation coefficient between coaxial waveguide ports 1 and 2.
Figure 8B:
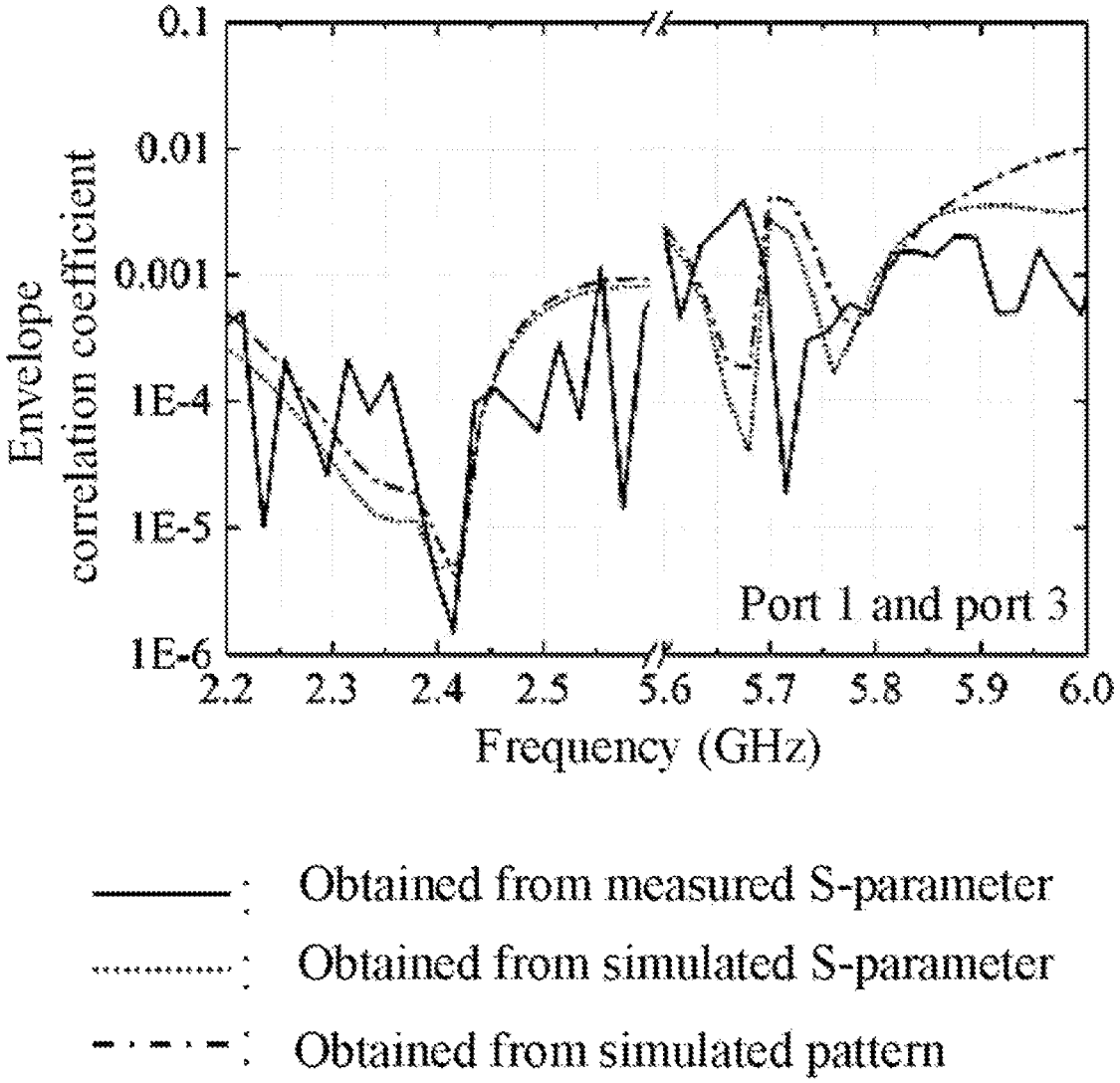
FIG. 8B shows envelope correlation coefficients between three ports, representing the envelope correlation coefficient between coaxial waveguide ports 1 and 3.
Figure 8C:
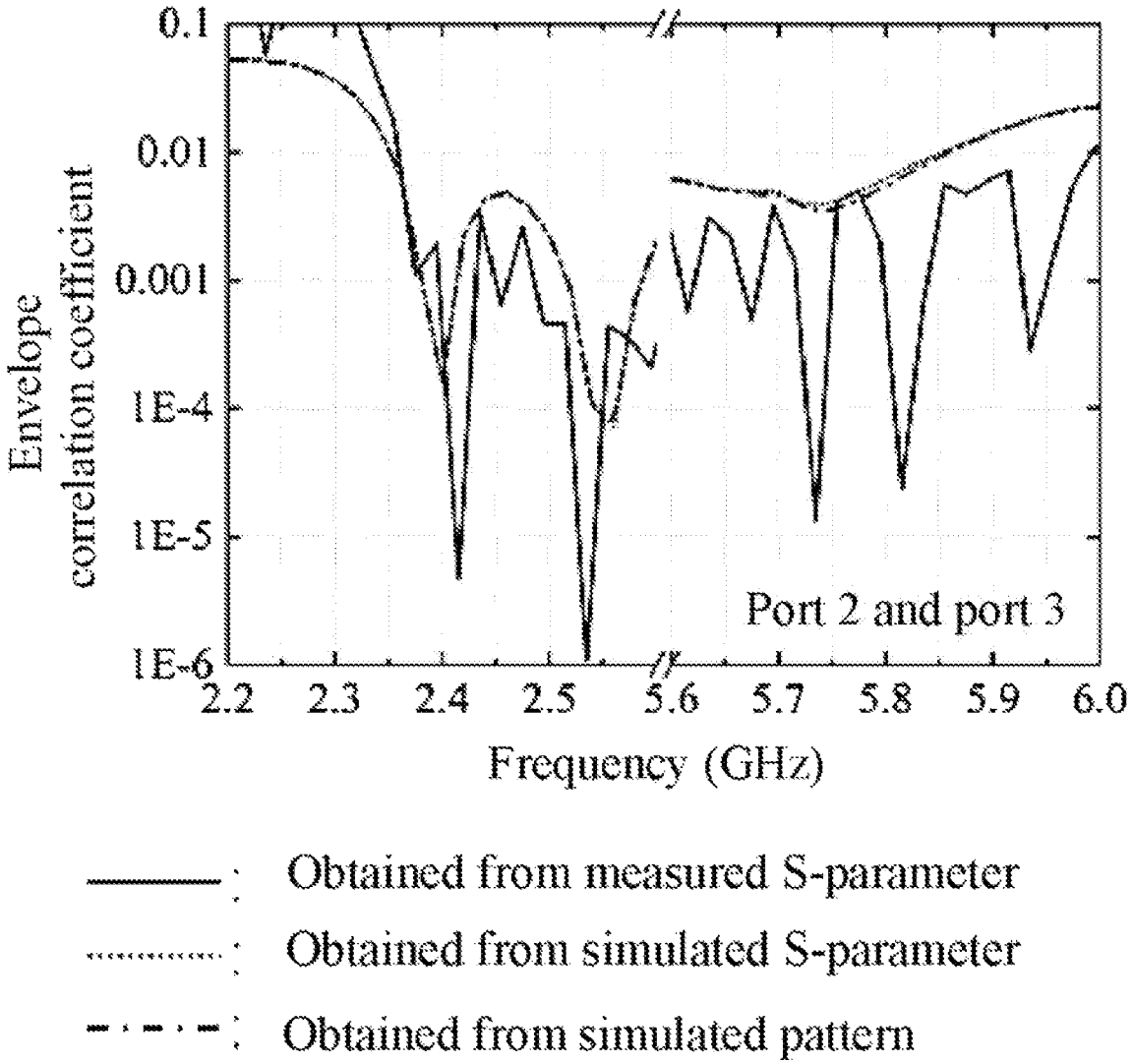
FIG. 8C shows envelope correlation coefficients between three ports, representing the envelope correlation coefficient between coaxial waveguide ports 2 and 3.

FIGS. 8A-8C show the envelope correlation coefficients of the dual-band triple-polarized antenna based on shielded mushroom structures 4 in free space. It can be seen from the figure that the envelope correlation coefficients calculated from the simulated scattering parameters and three-dimensional patterns agree well with each other within the working bands due to the high port isolation and pattern orthogonality. The envelope correlation coefficients calculated from the measured scattering parameters are also lower than 0.01, which have met the requirements for channel independence in the multi-input multi-output antenna.

The foregoing descriptions are exemplary implementations of the present invention. It should be noted that a person of ordinary skill in the art can make some improvements and modifications without departing from the principle of the present invention and the improvements and modifications shall fall within the protection scope of the present invention.

What is claimed is:

1. A dual-band triple-polarized antenna based on shielded mushroom structures, comprising a vertically-polarized radiator and a horizontally-polarized radiator, wherein the horizontally-polarized radiator is located on one side of the vertically-polarized radiator, and the vertically-polarized radiator and the horizontally-polarized radiator are fixedly connected in a disc-shaped structure; the vertically-polarized radiator is a first multilayer structure and the horizontally-polarized radiator is a second multilayer structure; each of the first multilayer structure and the second multilayer structure comprises a plurality of concentric circles, and the plurality of concentric circles comprise a plurality of dielectric substrates;

the vertically-polarized radiator and the horizontally-polarized radiator each comprise a plurality of shielded mushroom cell structures, and each shielded mushroom cell structure of the plurality of shielded mushroom cell structures comprises at least three metal layers and a metallic shorting pin; and the metallic shorting pin connects at least two of the at least three metal layers, wherein the vertically-polarized radiator comprises in sequence from one side to another side: a top patch of the vertically-polarized radiator, a parasitic disc patch, an annular patch array, and a metal floor of a lower radiator, and further comprises a plurality of shorting pin ring arrays connecting the annular patch array to the metal floor of the lower radiator;

the annular patch array comprises two to five concentric annular patches, and the two to five concentric annular patches comprise a plurality of patches;

the plurality of shorting pin ring arrays comprise a plurality of shorting pin structures;

the plurality of patches are connected to the plurality of shorting pin structures, and the top patch of the vertically-polarized radiator is adhered to the horizontally-polarized radiator.

2. The dual-band triple-polarized antenna according to claim 1, wherein a feeding structure of the vertically-polarized radiator comprises a vertical-body coaxial waveguide port connected to the parasitic disc patch; and the vertical-body coaxial waveguide port is connected to the metal floor of the lower radiator.

3. The dual-band triple-polarized antenna according to claim 2, wherein a shorting pin is loaded in a vicinity of the vertical-body coaxial waveguide port in a direction with $\varphi=45°$, and the shorting pin connects the top patch of the vertically-polarized radiator to the metal floor of the lower radiator.

4. The dual-band triple-polarized antenna according to claim 1, wherein the one side of the vertically-polarized radiator comprises two non-metallized via holes.

5. The dual-band triple-polarized antenna according to claim 1, wherein the horizontally-polarized radiator is fixedly connected to the vertically-polarized radiator by using a non-metallic fixing device.

6. The dual-band triple-polarized antenna according to claim 1, wherein the horizontally-polarized radiator comprises a symmetrical rectangular radiator structure.

7. A dual-band triple-polarized antenna based on shielded mushroom structures, comprising a vertically-polarized radiator and a horizontally-polarized radiator, wherein the horizontally-polarized radiator is located on one side of the vertically-polarized radiator, and the vertically-polarized radiator and the horizontally-polarized radiator are fixedly connected in a disc-shaped structure; the vertically-polarized radiator is a first multilayer structure and the horizontally-polarized radiator is a second multilayer structure; each of the first multilayer structure and the second multilayer structure comprises a plurality of concentric circles, and the plurality of concentric circles comprise a plurality of dielectric substrates;

the vertically-polarized radiator and the horizontally-polarized radiator each comprise a plurality of shielded mushroom cell structures, and each shielded mushroom cell structure of the plurality of shielded mushroom cell structures comprises at least three metal layers and a metallic shorting pin; and the metallic shorting pin connects at least two of the at least three metal layers, wherein the horizontally-polarized radiator comprises in sequence from one side to another side: a top patch of the horizontally-polarized radiator, a patch array, and a metal floor of an upper radiator, and further comprises a plurality of shorting pin arrays connecting the patch array to the metal floor of the upper radiator;

the patch array comprises a plurality of patches; and the metal floor of the upper radiator is adhered to the vertically-polarized radiator.

8. The dual-band triple-polarized antenna according to claim 7, wherein a feeding structure of the horizontally-polarized radiator comprises horizontally-polarized coaxial waveguide ports and microstrips connected and loaded by the horizontally-polarized coaxial waveguide ports;

the microstrips are located between the top patch of the horizontally-polarized radiator and the patch array;

the horizontally-polarized coaxial waveguide ports are connected to the patch array and the metal floor of the upper radiator; and an included angle of 90° is formed between the horizontally-polarized coaxial waveguide ports, and an included angle of 90° is formed between the microstrips.

9. The dual-band triple-polarized antenna according to claim 7, wherein the patch array is annular or polygonal.

* * * * *